US010045592B2

(12) United States Patent
Tozzi et al.

(10) Patent No.: US 10,045,592 B2
(45) Date of Patent: Aug. 14, 2018

(54) TOE PROTECTOR FOR ATHLETIC FOOTWEAR HAVING REMOVABLE CLEATS

(71) Applicant: ProtecTozz LLC, Bentleyville, OH (US)

(72) Inventors: Mark Anthony Tozzi, Bentleyville, OH (US); Nathaniel Ray Ward, Mentor, OH (US); Michael Paul Tozzi, Bentleyville, OH (US)

(73) Assignee: ProtecTozz, LLC, Bentleyville, OH (US)

( * ) Notice: Subject to any disclaimer, the term of this patent is extended or adjusted under 35 U.S.C. 154(b) by 0 days.

(21) Appl. No.: 14/452,265

(22) Filed: Aug. 5, 2014

(65) Prior Publication Data

US 2015/0040440 A1 Feb. 12, 2015

Related U.S. Application Data

(63) Continuation-in-part of application No. 13/961,288, filed on Aug. 7, 2013.

(Continued)

(51) Int. Cl.

| | |
|---|---|
| ***A43B 7/32*** | (2006.01) |
| ***A43B 23/08*** | (2006.01) |
| ***A43B 5/02*** | (2006.01) |

(52) U.S. Cl.

CPC ..... *A43B 23/087* (2013.01); *A43B 5/02* (2013.01)

(58) Field of Classification Search

CPC ..... A43B 5/18; A43B 23/081

See application file for complete search history.

(56) References Cited

U.S. PATENT DOCUMENTS 536,812 A 4/1895 Mabee
1,053,024 A * 2/1913 Fritzsohe ..... A43B 7/32 36/72 R (Continued)

FOREIGN PATENT DOCUMENTS

WO 2009/072857 6/2009

OTHER PUBLICATIONS

ABS Material Data Sheet, TSL Website. Retrieved Mar. 25, 2016. http://www.teststandard.com/data_sheets/ABS_Data_sheet.pdf (A PDF is in Application under "Office Action Appendix" dated Mar. 25, 2016).*

(Continued)

*Primary Examiner* — Richale Quinn
*Assistant Examiner* — Anne Kozak
(74) *Attorney, Agent, or Firm* — AlaviIP, LLC; Atossa M. Alavi

(57) ABSTRACT

A toe protector adapted to be removably attached to an external portion of the toe-box of cleated athletic footwear having removable cleats to protect an athlete's foot from crush injuries. The toe protector includes plantar flanges, each having at least one threaded cleat stud receiving hole used to attach the toe protector to the cleated athletic footwear in an external relationship. It is formed plastic, polycarbonate, or other materials, having sufficient thickness and hardness to withstand deformation and deflect crush forces applied to the toe-box of the cleated athletic footwear. It is designed to be universally applicable to most all athletic footwear having removable cleats available from known manufacturers and can be easily transferable to other similarly sized cleated footwear.

15 Claims, 13 Drawing Sheets

Related U.S. Application Data

(60) Provisional application No. 61/923,874, filed on Jan. 6, 2014.

(56) References Cited

U.S. PATENT DOCUMENTS 1,118,755 A * 11/1914 Fiscus ..... A43B 1/00 36/77 R
2,007,728 A * 7/1935 Ranauro ..... A43C 13/14 36/72 R
2,087,634 A * 7/1937 Wimmenauer ..... A43C 15/066 36/134
2,179,942 A * 11/1939 Lyne ..... A43B 5/001 36/127
2,325,741 A * 8/1943 Chertok ..... A43B 5/12 36/1
2,747,303 A * 5/1956 Abrahams ..... A43C 13/14 36/72 R
2,864,180 A * 12/1958 Montgomery ..... A43B 5/18 36/126
3,012,343 A * 12/1961 Dinkel ..... A43B 5/18 36/130
3,054,197 A * 9/1962 Morgan ..... A43C 15/161 36/59 R
3,063,165 A * 11/1962 Brough ..... A43B 5/18 36/7.7
3,310,889 A 3/1967 Samuels
3,481,055 A * 12/1969 Herman ..... A43B 1/14 36/126
3,486,248 A * 12/1969 Iversen ..... A43B 1/10 36/7.3
3,497,972 A * 3/1970 Lyman ..... A43B 5/00 36/132
3,525,165 A * 8/1970 Richmond, Jr. ..... A43B 5/02 36/128
3,566,488 A * 3/1971 Pilarski ..... A43B 5/815 36/7.5
3,842,520 A * 10/1974 Heptig ..... A43B 13/24 36/74
3,851,410 A * 12/1974 Frazier ..... A43B 5/18 36/133
4,051,612 A * 10/1977 Damron ..... A43C 13/14 36/72 R
4,103,438 A * 8/1978 Fron ..... A43B 23/087 36/72 R
4,177,583 A * 12/1979 Chapman ..... A43C 13/14 36/110
4,333,248 A * 6/1982 Samuels ..... A43B 3/18 36/101
4,735,003 A * 4/1988 Dykeman ..... A43B 23/087 36/72 R
4,896,439 A * 1/1990 Morgan ..... A43B 5/18 36/115
4,995,174 A * 2/1991 Hong ..... A43C 13/14 36/72 R
5,074,060 A * 12/1991 Brncick ..... A43C 13/14 36/72 R
5,331,751 A * 7/1994 Harwood ..... A43B 23/086 36/72 R
5,566,476 A 10/1996 Bertrand et al.
5,737,858 A * 4/1998 Levy ..... A43B 5/02 36/128
5,809,666 A 9/1998 Harwood
5,878,511 A 3/1999 Krajcir
5,887,363 A 3/1999 Rhodes
6,038,792 A * 3/2000 Hauter ..... A43B 5/02 36/133
6,412,195 B1 * 7/2002 Mack ..... A43B 23/082 36/114
6,505,422 B2 * 1/2003 Racine ..... A43B 23/087 36/115
6,568,101 B1 * 5/2003 Jansen ..... A43B 1/0072 36/127
6,647,576 B2 11/2003 Racine
6,802,318 B1 * 10/2004 Parker ..... A61F 5/019 128/882
6,874,256 B2 4/2005 Delgatty
6,886,275 B1 * 5/2005 Westfall ..... A43B 3/20 36/128
7,836,610 B2 11/2010 Laporte
7,908,771 B2 * 3/2011 Foxen ..... A43B 7/20 36/100
8,230,621 B2 7/2012 Shmurak et al.
2002/0043007 A1 * 4/2002 Hannah ..... A43B 5/02 36/133
2002/0066208 A1 * 6/2002 Hall ..... A43B 3/0078 36/7.3
2004/0009337 A1 * 1/2004 Tanaka ..... A43B 23/087 428/292.1
2004/0049949 A1 * 3/2004 Valentini ..... A43B 1/0072 36/77 R
2004/0079001 A1 * 4/2004 McMullin ..... A43D 100/14 36/134
2004/0200097 A1 * 10/2004 Boyd ..... A43B 3/0078 36/96
2005/0076538 A1 * 4/2005 Sapp ..... A43B 5/18 36/72 R
2005/0144812 A1 * 7/2005 Wheeler ..... A43B 3/0078 36/133
2007/0068045 A1 * 3/2007 Condie ..... A43B 3/00 36/101
2009/0013555 A1 * 1/2009 Vitulli ..... A43B 7/12 36/10
2009/0077832 A1 * 3/2009 Flint ..... A43B 5/02 36/133
2009/0083993 A1 * 4/2009 Plank ..... A43B 3/0078 36/7.3
2010/0101116 A1 * 4/2010 Serafino ..... A43B 5/02 36/128
2010/0275463 A1 * 11/2010 Gallagher ..... A43B 5/02 36/133
2011/0047829 A1 * 3/2011 Bell ..... A43B 5/18 36/134
2011/0154690 A1 * 6/2011 Walsh ..... A43B 5/18 36/134
2013/0111783 A1 * 5/2013 Serafino ..... A43B 5/02 36/133
2013/0255111 A1 * 10/2013 Sakurai ..... A43B 7/32 36/77 R
2014/0020267 A1 * 1/2014 Perez ..... A43C 15/00 36/59 R
2015/0040439 A1 * 2/2015 Tozzi ..... A43B 5/02 36/77 R
2015/0040440 A1 * 2/2015 Tozzi ..... A43B 23/087 36/77 R
2015/0189940 A1 * 7/2015 Teichert ..... A43B 3/16 36/72 R

OTHER PUBLICATIONS

Acrylonitrile Butadiene Syrene (AB) Typical Properties Generic ABS. UL Prospector Web. Retrieved by Applicant on Jan. 24, 2017. https://plastics.ulplastics.ulprospector.com/generics/1/c/t/acrylonitrile-butadiene-styrene-abs-properties-processing (A PDF is in Application under "Non-Patent Literature" dated (Feb. 7, 2017).*

Polycarbonate (PC) Typical Properties Generic PC. UL Prospector Web. Retrieved May 25, 2017. https://plastics.ulprospector.com/generics/25/c/t/polycarbonate-pc-properties-processing/sp/9.*

* cited by examiner

TOE PROTECTOR FOR ATHLETIC FOOTWEAR HAVING REMOVABLE CLEATS

BACKGROUND

Disclosed in embodiments herein is an impact protection device for an athletic shoe, and more specifically a detachable toe protector for athletic footwear having removable cleats.

Athletes are prone to a common type of foot injury while wearing cleated footwear which involves crushing or deformation of the toe-box area when external compressive forces are applied to the front of the footwear. Football players, especially offensive and defensive linemen, are susceptible to crush injuries from another player stepping on the player's cleated footwear, shown generally at 100 in FIG. 1. Rugby players encounter similar injuries. Baseball players face a variety of hazards including foul tips off the player's foot, and being spiked by another player's cleat which crushes the toe-box of the cleat. The toe-box 110 of athletic cleated footwear 100, including football cleats and baseball cleats, among others, will typically collapse or deform during these events as they come under loads which might exceed six times body weight. The resulting injuries can be acute, subacute or chronic and can include, but are not limited to subungual hematoma (i.e. blood clot under the injured toenail), ingrown toenail, sprain-ligament damage (known as "turf toe"), fracture, extensor/flexor tendonitis or tear. These injuries can adversely affect an athlete's performance and may require significant medical treatment and prolonged rehabilitation. They can also be prone to re-injury.

Conventional athletic footwear having cleats 120, referred to herein as cleated footwear or cleat shoe 100, does not provide protection against such injuries. The toe-box 110 of conventional cleated footwear remains relatively unprotected.

Toe protection has been used for non-athletic footwear, such as work boots for some time. "Steel-toed shoes" have offered toe protection against crush injuries in all types of industries, ranging from mining, factory, automobile, etc. However, these devices are not designed for the cleated athlete.

It is desirable to protect an athlete wearing cleated footwear from a foot injury by guarding the toe-box against incursion while providing the full range of motion offered by conventional, unprotected cleats.

DETAILED DESCRIPTION

Figure 1:
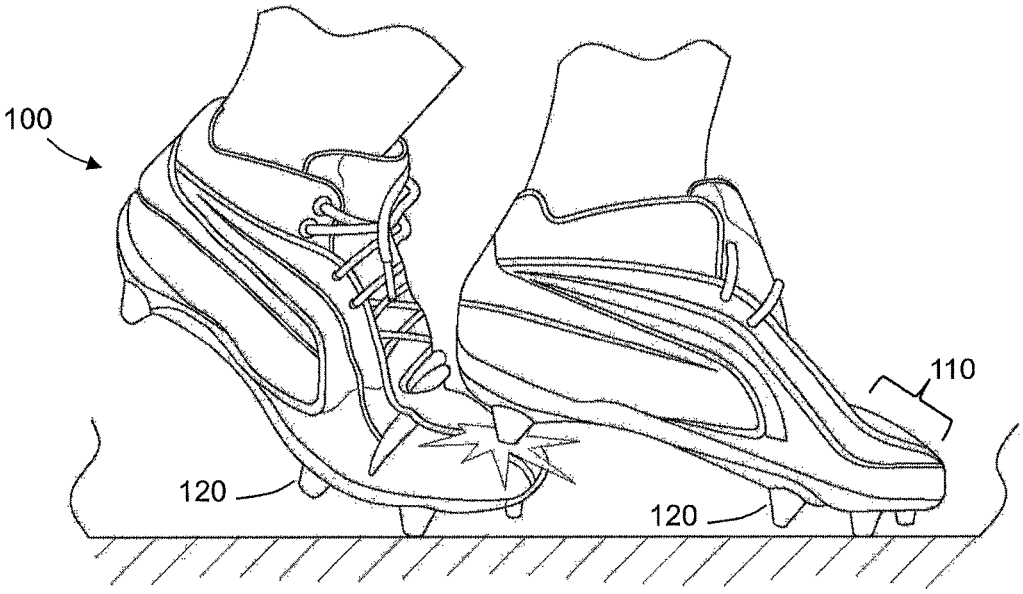
FIG. 1 is a perspective view illustrating a conventional cleated athletic shoe with removable cleats having an unprotected toe-box.
Figure 2:
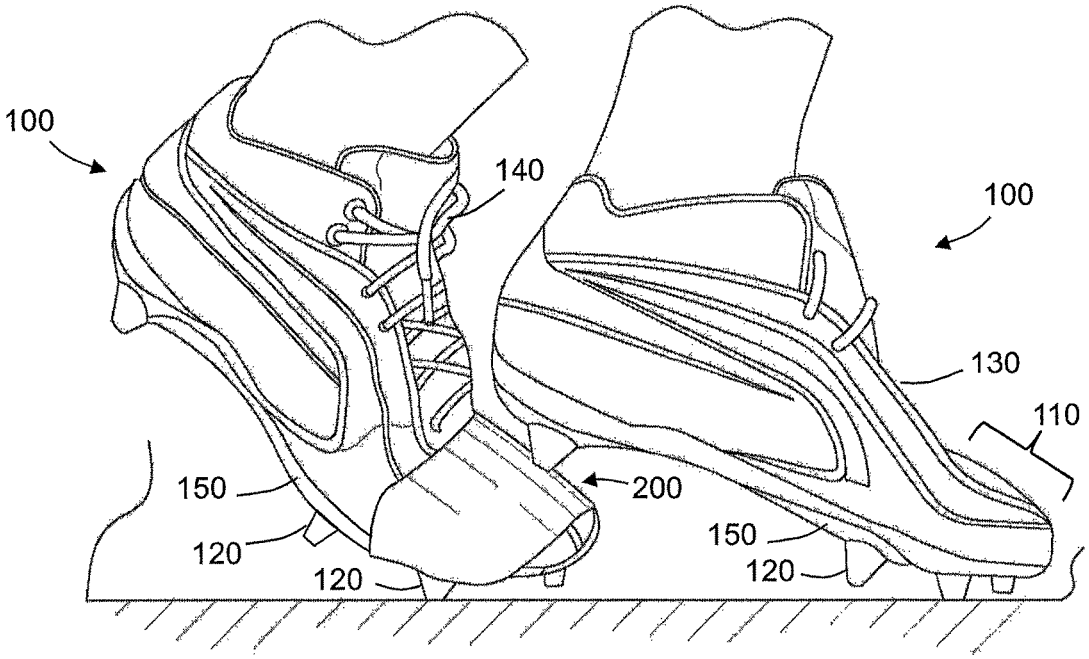
FIG. 2 is a perspective view illustrating the conventional cleated athletic shoe of FIG. 1*a* with a toe protector in accordance with the present invention.

Referring now to FIG. 2, a toe protector, shown generally at 200, is provided for removable external attachment to cleated athletic footwear 100 having removable cleats 120. Cleated athletic footwear 100 is manufactured in three styles, including: high-tops, mid-cut, and low-cut. The toe protector 200 is designed to be used with all three styles. Some cleated footwear have fixed, non-removable cleats (not shown) which cannot be taken off the shoe. Other cleated footwear 100 have removable cleats 120 which can be easily removed from the footwear and replaced, as shall be described in further detail below. The toe protector 200 is used with cleated footwear 100 having removable cleats 120. Cleats 120 come in a range of different sizes, including ½ inch, ⅝ inch, ¾ inch, and 1 inch sizes, among others, to enable the athlete to optimize traction for different field conditions. As such, removable cleats 120 are typically preferred over non-removable cleats, and their use may even be mandated. The toe protector 200 can be used with all sizes of removable cleats 120. Some cleated footwear 100 includes both removable cleats 120 and non-removable cleats. The toe protector 200 can also be used with many of these cleated footwear 100 as well.

The cleated footwear 100 includes an upper portion 130, also known as the upper, which is typically made from leather or synthetic material. The upper 130 includes laces 140, or other fastening arrangements, which are tightened to secure the cleated footwear 100 to an athlete's foot in a conventional manner. The toe protector 200 is adapted to be externally secured over the toe-box portion 110 of the upper 130 without attachment to the upper itself, as shall be described in further detail below.

Figure 4:
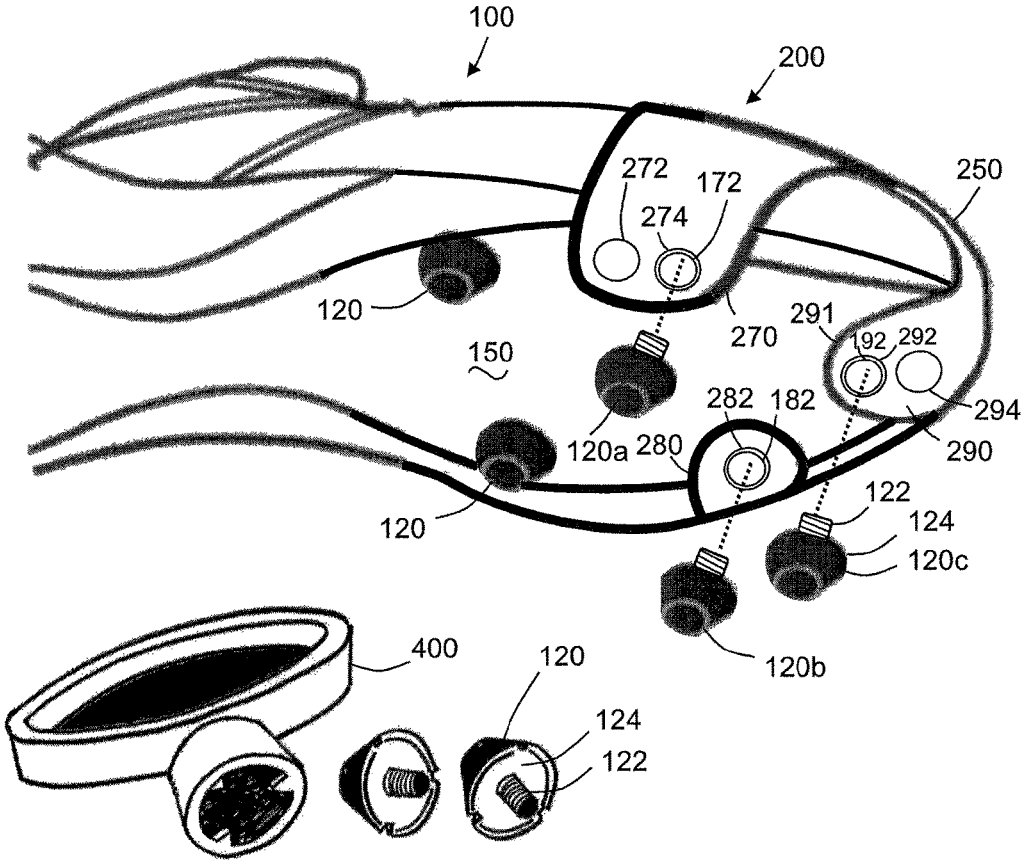
FIG. 4 is a perspective view of a right foot toe protector being attached to the right foot of a cleated athletic shoe with removable cleats.

The cleated footwear 100 also includes a lower, referred to herein as a sole 150, attached to the upper 130 in a conventional manner. The removable cleats 120 include a threaded stud 122 extending from the base 124 of the cleat, as shown in FIG. 4. The removable cleats 120 are typically screwed into threaded holes in the bottom of the sole 150 until the base 124 abuts the sole.

Figure 3A:
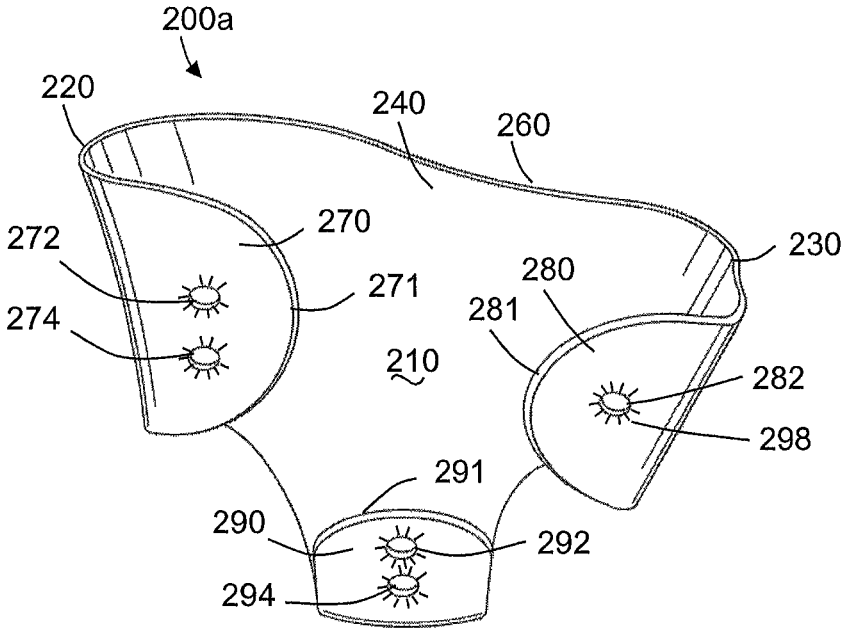
FIG. 3*a* is a perspective bottom view of a left foot toe protector in accordance with the present invention.
Figure 3B:
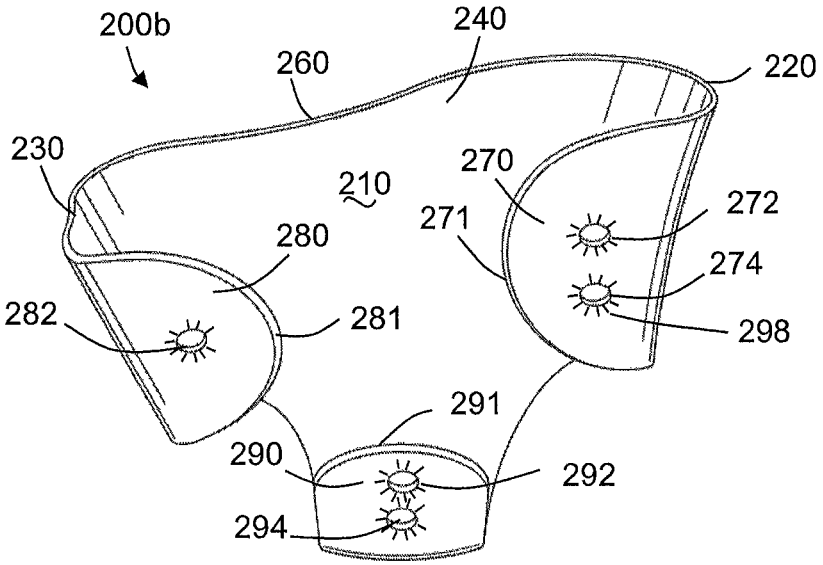
FIG. 3*b* is a perspective bottom view of a right foot toe protector in accordance with the present invention.

Referring now to FIGS. 3*a* and 3*b*, each toe protector 200 can be left foot/right foot specific. In this example, a pair of toe protectors will be used which includes a left foot toe protector shown at 200*a* in FIG. 3*a*, and a right foot toe protector 200*b* shown in FIG. 3*b*. The toe protectors 200*a*, 200*b* include similar features, though medial and lateral features will be disposed on opposite sides. Thus, the toe protectors 200*a*, 200*b* are referred to generally as toe protector 200 and the description of such is applicable to both.

The toe protector 200 includes a one-piece body 210 having a lateral wall 220, a medial wall 230, and a central portion 240 disposed between the lateral and the medial walls. The body 210 is arc-shaped, forming a smooth curve, moving from the lateral wall 220 to the central portion 240 to the medial wall 230 to conform to the external dimensions of the toe-box portion 110 of the cleated footwear 100. The body 210 includes a distal end 250 adapted to be disposed closest to the front of the footwear 100 and an oppositely disposed proximal end 260 adapted to be disposed closer to the laces 140, when attached to the cleated footwear 100. In one non-limiting example, the lateral wall 220 and medial wall 230 are curved and non-parallel moving from the proximal end 260 to the distal end 250 such that the distance between these walls is greater at the proximal end than at the distal end so as to conform to the shape of the toe-box 110 of the cleated footwear 100.

A lateral plantar flange 270 extends from a lower portion of the lateral wall 220 and terminates in a lateral plantar flange end 271. A medial plantar flange 280 extends from a lower portion of the medial wall 230 and terminates in a medial plantar flange end 281. The lateral and medial plantar flanges 270, 280 extend towards each other from the respective lateral and medial walls 220, 230 and terminate in the respective ends 271, 281 which are spaced apart from each other, as shown.

The lateral plantar flange 270 includes one or more threaded cleat stud receiving holes. In one example, as shown in FIGS. 3*a* and 3*b*, the lateral plantar flange 270 includes a pair of spaced apart threaded cleat stud receiving holes including a first hole 272 disposed closer the proximal end 260, and a second hole 274 disposed adjacent the first hole and closer to the distal end 250. In use, only one of first and second threaded cleat stud receiving holes 272, 274 will be used for securing the toe protector to a particular cleated shoe, as described below. The threaded cleat stud receiving holes 272, 274 can be round having diameter of about 0.15 inches to about 0.35 inches, and more preferably about 0.20 inches to about 0.30 inches, an example of which can be about 0.25 inches, though it should be appreciated that other suitable sizes can be contemplated. The distance between the centers of the threaded cleat stud receiving holes 272, 274 can be about 0.30 inches to about 1.0 inch, and more preferably about 0.30 to about 0.60 inches, an example of which can be about 0.375 inches, though it should be appreciated that other suitable distances can be contemplated. Including both threaded cleat stud receiving holes 272 and 274 in the lateral plantar flange 270 in this manner enables the toe protector 200 to fit a greater range of sizes of cleated footwear The medial plantar flange 280 includes one or more threaded cleat stud receiving holes. In one example, as shown in FIGS. 3*a* and 3*b*, the medial plantar flange 280 includes a single threaded cleat stud receiving hole 282. The threaded cleat stud receiving hole 282 can be round having diameter of about 0.15 inches to about 0.35 inches, and more preferably about 0.20 inches to about 0.30 inches, an example of which can be about 0.25 inches, though it should be appreciated that other suitable sizes can be contemplated. It should be appreciated that the lateral plantar flange 270 and/or the medial plantar flange 280 can include one, two or more threaded cleat stud receiving holes, some examples of which are described in further detail below.

The lateral and medial plantar flanges 270, 280 are shaped to closely conform to the shape of respective lateral and medial portions of the sole 150. As such, in one example, the flanges 270, 280 can be generally flat moving from the proximal end 260 to the distal end 250. In another example, the flanges 270, 280 can include curved portions. In one example, the flanges 270, 280 can be generally coplanar, so as to closely conform to the front portion of the sole 150. In other examples, at least portions of the flanges 270, 280 are not coplanar so that they closely conform to the sole 150 of other cleated footwear.

Figure 6:
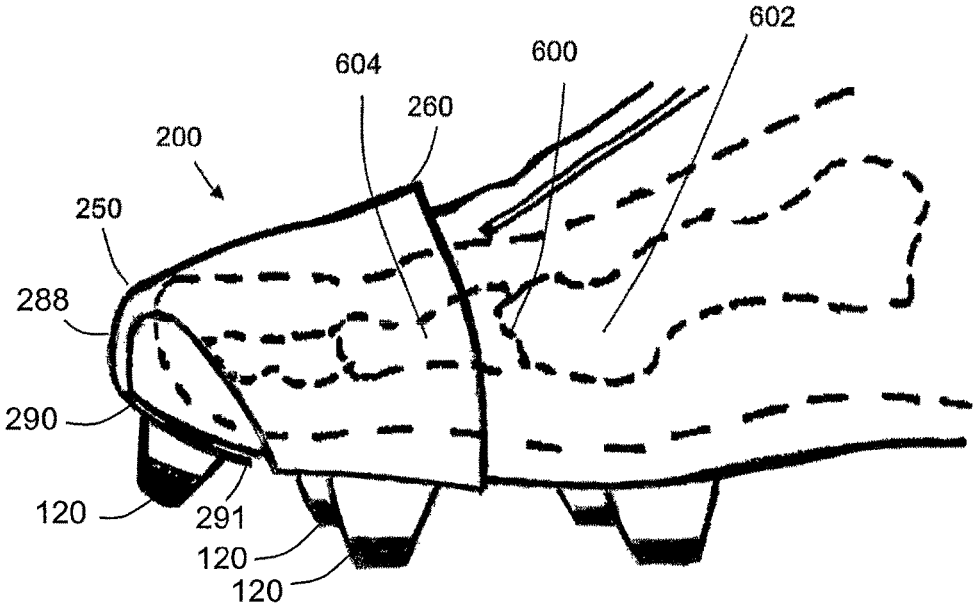
FIG. 6 is a side view of a left foot toe protector attached to a cleated athletic shoe showing the toe protector in relation to the bone structure of an athlete's left foot.

Referring now to FIGS. 3*a*, 3*b* and 6, the toe protector 200 can include a distal wall, also referred to as a front wall 288 extending downwards from the distal end 250 of the central portion 240. The distal wall 288 extending downwards from the distal end 250 of the central portion 240. The distal wall 288 is adapted to extend over the front of the shoe's toebox 110. A distal planter flange 290 extends from a lower portion of the distal wall 288 towards the proximal end of the toe protector and terminates in a distal plantar flange end 291. The distal plantar flange 290 includes one or more threaded cleat receiving holes. In one example, as shown in FIGS. 3*a* and 3*b*, the distal plantar flange 290 includes a pair of threaded cleat stud receiving holes including a first threaded cleat stud receiving hole 292 disposed adjacent the distal planter flange end 291 and a second threaded cleat stud receiving hole 294 disposed between the first hole and the distal wall 288. In use, only one of first and second threaded cleat stud receiving holes 292, 294 will be used for securing the toe protector to a particular cleated shoe, as described below. The threaded cleat stud receiving holes 292, 294 can be round having diameter of about 0.15 inches to about 0.35 inches, and more preferably about 0.20 inches to about 0.30 inches, an example of which can be about 0.25 inches, though it should be appreciated that other suitable sizes can be contemplated. The distance between the centers of the threaded cleat stud receiving holes 292, 294 can be about 0.30 inches to about 1.0 inch, and more preferably about 0.30 to about 0.60 inches, an example of which can be about 0.50 inches, though it should be appreciated that other suitable distances can be contemplated. Including both threaded cleat stud receiving holes 292, 294 in the distal plantar flange 290 in this manner enables the toe protector 200 to fit a greater range of sizes of cleated footwear 100.

The distal plantar flange 290 is shaped to closely conform to the shape of the front portion of the sole 150. As such, in one example, the flange 290 can be generally flat. In one example, the distal plantar flange 290 can be generally coplanar with the lateral plantar flange 270 and the medial plantar flange 280, so as to closely conform to the front portion of the sole 150. In another example, the distal plantar flange 290 is not coplanar with the lateral plantar flange 270 and the medial plantar flange 280.

The toe protector 200 can include a set of radial grooves 298 formed in the surface of one or more flanges 270, 280, and 290 surrounding one or more, including all, of the threaded cleat stud receiving holes 272, 274, 282, 284, 292, 294. The radial grooves 298 extend from the threaded cleat stud receiving holes in a radial or stellate configuration. The grooves 298 increase the surface friction of the flange surface against which the cleat base 124 is tightened when attaching the toe protector to the cleated footwear 100 in the manner described below. The grooves 298 improve the retention the tightened cleat 122 by preventing it from loosening during use.

The toe protector 200 can be made in different sizes and shapes to fit different models of cleated footwear manufactured by any cleated footwear maker. Further, it can be made in different sizes to fit different sized cleated footwear from pediatric-sized to adolescent-sized to adult-sized. As mentioned, one or more of the threaded cleat stud receiving holes can be round. In another example one or more of the threaded cleat stud receiving holes can be slotted, as shown at 872, 874, 882 and 884 in FIG. 11, to accommodate different cleat layouts and different sizes of cleated footwear 100. The threaded cleat stud receiving holes of the toe protector described herein, are large enough to receive the threaded cleat stud 122, but are smaller than the cleat base 124 from which the stud extends, so that the cleat base holds the respective flange against the bottom of the sole 150 to secure the toe protector to the cleated footwear 100, as described in further detail below.

The body 210, including the entire toe protector 200, is semi-rigid and malleable so as to withstand deformation and deflect crush forces applied to the toe-box 110 of the footwear 100. The body 210 is formed plastic, or other materials, having sufficient thickness and hardness to protect the toe-box 110 as discussed herein. In one non-limiting example, the body is formed of Acrylonitrile Butadiene Styrene (ABS), which is a plastic material having a tensile strength of about 4000 psi to about 7000 psi, and more preferably about 5100 psi to about 6100 psi, and a Rockwell hardness score of about R90 to about R120 and more preferably about R102 to about R109, though it should be appreciated that other suitable ranges of tensile strength and hardness may be used. The material of this non-limiting example has an impact strength of about 5.2 ft-lbs/in to about 7.7 ft-lbs/in, which provides optimal impact absorption so as to deflect the energy of the impact of another player stepping on a player's foot thereby protecting the vulnerable area of the athlete's forefoot. The thickness of the toe protector body 210 is about 0.0625 inches thick when made of ABS, though other suitable thicknesses are contemplated.

The toe protector 200 is lightweight, weighing about 20 grams to about 30 grams, by way of non-limiting example, to minimize its influence on the athlete's performance. In one example, the toe protector 200 weights about 25 grams. It can be made available in various colors, including black, to blend with the athletic shoe 100. It should be appreciated that other materials besides ABS plastic can be used, including but not limited to Lexan (Polycarbonate), having a tensile strength of about 8000 psi to about 16,000 psi, a Rockwell hardness score of about R118 to about R126 and an impact strength of about 1.5 ft-lbs/in to about 18 ft-lbs/in. The thickness of the Lexan toe protector can be about 0.08 inches to about 0.1 inches thick, though other suitable thicknesses are contemplated. In another example, the toe protector body 210 can be made of high impact polypropylene and/or high molecular weight polyethylene.

The toe protector 200 can be formed by heat molding. In a first example, it can be formed by thermoforming. A sheet of plastic/polymer, also referred to as themoplastic is heated to a temperature that enables it to be molded. The sheet is then formed into or around a mold and allowed to cool. It is then trimmed off the mold. In another example, the toe protector 200 can be formed by injection molding. Plastic/polymer material is melted to a liquid state and then forced into a mold. It is allowed to cool and harden in the mold and then released. In another example, the toe protector can be formed by blow molding. The plastic/polymer material is melted down and formed into a pre-form shape. The pre-form is then clamped into a mold and air is pumped into the pre-form. The plastic/polymer expands against the sides of the mold, where it is held and allowed to cool, taking on the shape of the mold. Trimming can be done if needed.

Referring now to FIG. 4, the toe protector 200 is adapted to be easily attached and detached from cleated footwear 100 having removable cleats 120. The removable cleats 120 are attached to the footwear 100 by a threaded cleat stud 122 extending from the base 124 of the cleat. The threaded cleat stud 122 is received in a threaded hole in the bottom of the sole 150. A method of attaching the toe protector 200 to the footwear 100 can include removing the cleat 120*a* from the lateral side of the forefoot of the footwear, removing the cleat 120*b* from the medial side of the forefoot of the footwear, and removing the front cleat 120*c*. This is typically done using a cleat key 400, which is a wrench typically provided by the footwear manufacturer (or aftermarket manufacturers) that is specifically made to fit over the cleat 120 such that a flat, or protrusion, on the wrench 400 engages the cleat 120. The cleat 120 is removed by turning it until the threaded stud 122 is released from the threaded hole. The toe-protector 200 is then placed over the outside of the toe-box 110 such that the proximal end 260 faces towards the laces 150 and the distal wall 288 is adjacent the front of the shoe 100. In this external attachment, the lateral wall 220 extends around the lateral side of the footwear, the medial wall 230 extends around the medial side and the distal wall is adjacent the front of the shoe 100. The lateral planter flange 270, medial plantar flange 280 and distal plantar flange 290 extend over portions of the bottom of the sole 150. Though semi-rigid, the walls of the toe-protector 200 can be pulled apart somewhat to facilitate this placement.

The toe-protector 200 is then moved forward to backward over the shoe 100 until one of the threaded cleat stud receiving holes 272 or 274 in the lateral plantar flange 270 is aligned with the lateral threaded cleat stud receiving hole 172 in the sole 150, the threaded cleat stud receiving hole 282 in the medial plantar flange 280 is aligned the medial threaded cleat stud receiving hole 182 in the sole, and one of the threaded cleat stud receiving holes 292 or 294 in the distal plantar flange 290 is aligned with the front threaded cleat stud receiving hole 192 in the sole. The threaded cleat studs 122 of each respective removable cleat 120*a*, 120*b*, 120*c* are pushed through each of the threaded cleat stud receiving holes 272 or 274, 282, and 292 or 294 and into the corresponding holes 172, 182, 192 in the sole 150. The cleats 120 are then screwed onto the footwear using the wrench 400 until the cleat base 124 abuts the respective flange to secure the toe-protector 200 to the footwear 100. The toe-protector 200 can be easily removed from the cleated footwear by removing these three cleats 120*a*, 120*b*, 120*c* so that the toe-protector can then be pulled off of the shoe 100. In this manner, the toe protector 200 can be removed for cleaning and/or storage. The toe protector 200 is generally universal, and as such, it can be transferred to other similarly-sized cleated footwear 100.

Figure 5:
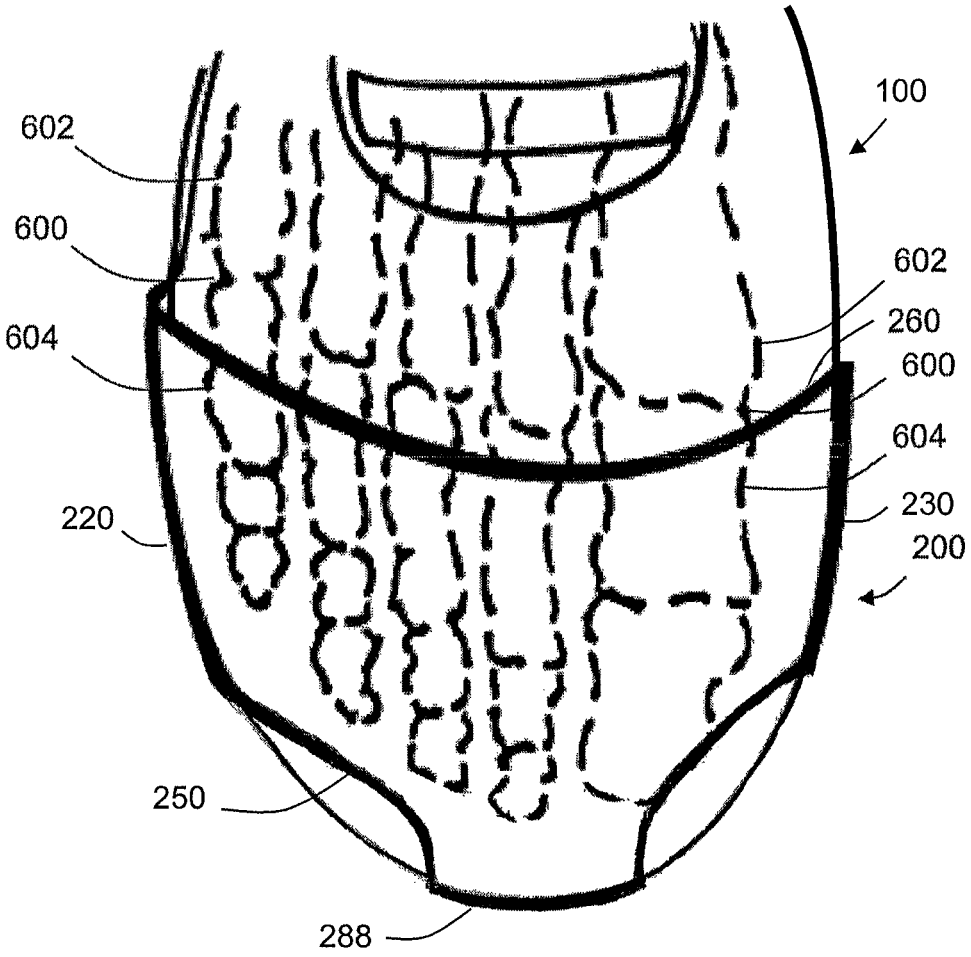
FIG. 5 is a plan view of a right foot toe protector attached to a cleated athletic shoe showing the toe protector in relation to the bone structure of an athlete's right foot.

Referring to FIGS. 5 and 6, the toe protector 200 is shown attached to the cleated footwear 100. The toe protector 200 extends over the athlete's 1st through 5th phalanges, including the distal, middle and proximal phalanges to protect them from crush injuries. Full protection of the great toe from crush injuries is a feature.

The proximal end 260 is curved to follow the curve of the first through fifth metatarsophalangeal articulations 600, that is the joints between the metatarsal bones 602 of the foot and the proximal phalanges 604 of the toes, referred to herein as the MTP joints, as shown in FIG. 6. In one example, this curve is a parabolic arc having a swept angle of about 142 degrees, +/− about 5 degrees, which follows the anatomic parabola of the MTP joints 600 of the athlete's foot beneath it. The proximal end 260 of the central portion 240 of the toe protector 200 extends to the first through fifth metatarsophalangeal articulations 600, that is the joints between the metatarsal bones 602 of the foot and the proximal phalanges 604 of the toes, referred to herein as the MTP joints, as shown in FIG. 5. The size, shape and orientation of the attached toe protector 200 allows the MTP joints 600 freedom of movement without compromising range-of-motion, push-off strength, running ability, etc.

The one-piece, semi-rigid toe protector 200 provides sufficient material strength to deflect impact forces away from the athlete's toes/forefoot and prevent crushing or other significant deformation of the footwear's toe-box 110. The toe protector 200 can be easily secured over the toe-box of the cleated footwear 100 using the footwear's removable cleats and thus, it does not require any changes or modifications to the footwear. The toe protector 200 can also be removed from the cleated footwear 200 in a simple manner, as discussed above.

Figure 7A:
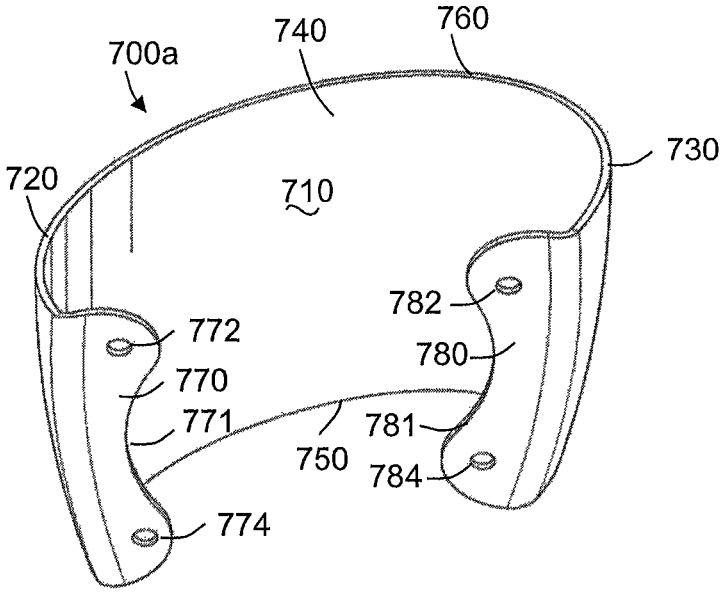
FIG. 7*a* is a perspective bottom view of a second embodiment of a left foot toe protector in accordance with the present invention.
Figure 7B:
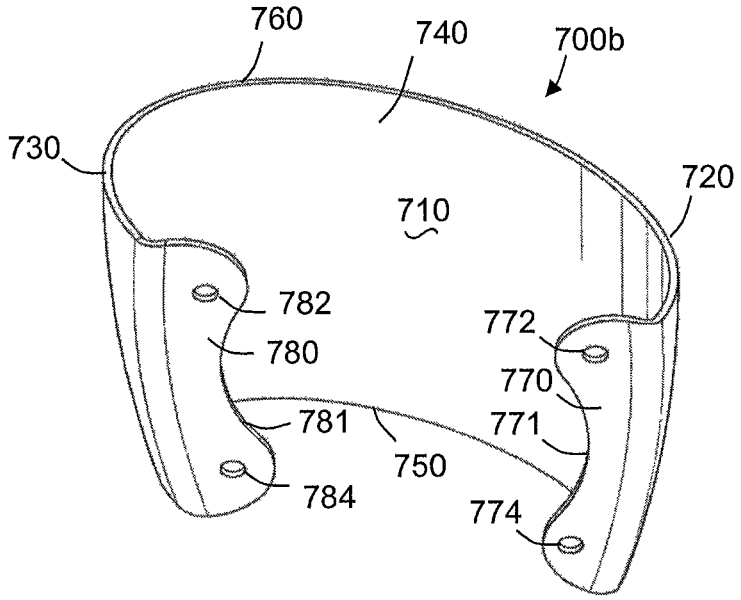
FIG. 7*b* is a perspective bottom view of a second embodiment of a right foot toe protector in accordance with the present invention.

Referring now to FIGS. 7*a* and 7*b*, another example of the toe protector is illustrated including a left foot toe protector 700*a* shown in FIG. 7*a*, and a right foot toe protector 700*b* shown in FIG. 7*b*. As discussed in reference to the previous example provided above, the toe protectors 700*a*, 700*b* include similar features, though medial and lateral features will be disposed on opposite sides and thus, the toe protectors 700*a*, 700*b* are referred to generally as toe protector 700 and the description of such is applicable to both.

The toe protector 700 includes a one-piece body 710 having a lateral wall 720, a medial wall 730, and a central portion 740 disposed between the lateral and the medial walls. The body 710 is arc-shaped, forming a smooth curve, moving from the lateral wall 720 to the central portion 740 to the medial wall 730 to conform to the external dimensions of the toe-box portion 110 of the cleated footwear 100. The body 710 includes a distal end 750 adapted to be disposed closest to the front of the footwear 100 and an oppositely disposed proximal end 760 adapted to be disposed closer to the laces 140, when attached to the cleated footwear 100. In one non-limiting example, the lateral wall 720 and medial wall 730 are curved and non-parallel moving from the proximal end 760 to the distal end 750 such that the distance between these walls is greater at the proximal end than at the distal end so as to conform to the shape of the toe-box 110 of the cleated footwear 100.

The lateral wall 720 terminates in a lateral plantar flange 770 having a pair of spaced apart threaded cleat stud receiving holes including a first hole 772 formed near the proximal end 760, and a second hole 774 formed near the distal end 750. The medial wall 730 terminates in a medial plantar flange 780 having a pair of spaced apart threaded cleat stud receiving holes, including a first hole 782 formed near the proximal end 760, and a second hole 784 formed near the distal end 750. The lateral and medial plantar flanges 770, 780 extend towards each other from the respective lateral and medial walls 720, 730 and terminate in respective ends 771, 781 which are spaced apart.

The lateral and medial plantar flanges 770, 780 are shaped to closely conform to the shape of respective lateral and medial portions of the sole 150. As such, in one example, the flanges 770, 780 can be generally flat moving from the proximal end 760 to the distal end 750. In another example, the flanges 770, 780 can include curved portions. In one example, two or more of the portions of the flanges 770, 780 having the threaded cleat stud receiving holes 772, 774, 782, 784 can be generally planar, so as to closely conform to the front portion of the sole 150. In other examples, the portions of the flanges 770, 780 having the threaded cleat stud receiving holes 772, 774, 782, 784 are not planar so that they closely conform to the sole 150 of other cleated footwear.

Figure 8:
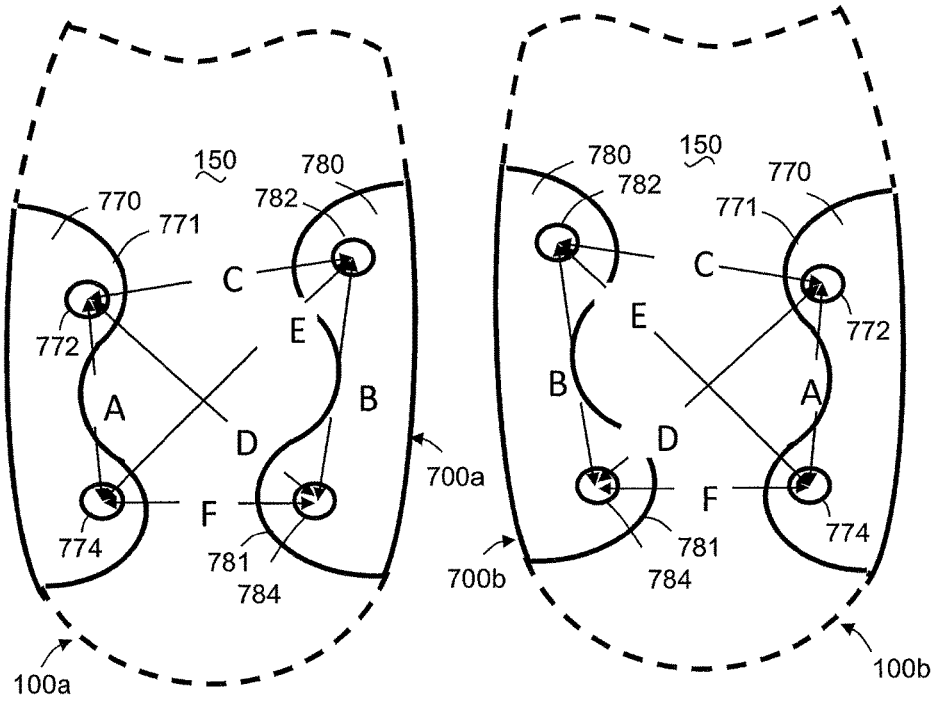
FIG. 8 is a bottom view illustrating distances between threaded cleat stud receiving holes of the second embodiment of the toe protector including a left foot toe protector and a right foot toe protector.

Referring now to FIG. 8, distances between the centers of the threaded cleat stud receiving holes are provided by way of example. The range of distances between the centers of the first threaded cleat stud receiving hole 772 and the second threaded cleat stud receiving hole 774 in the lateral planter flange 770, shown at A, is about 1.35 inches to about 7.65 inches, and more preferably about 1.60 inches to about 7.40 inches. The range of distances between the centers of the first threaded cleat stud receiving hole 782 and the second threaded cleat stud receiving hole 784 in the medial planter flange 780, shown at B, is about 1.05 inches to about 7.40 inches, and more preferably about 1.30 inches to about 7.15 inches. The range of distances between the centers of the first threaded cleat stud receiving hole 772 in the lateral plantar flange 770 and the first threaded cleat stud receiving hole 782 in the medial plantar flange 780, shown at C, is about 7.00 inches to about 3.25 inches, and more preferably about 7.25 inches to about 3.00 inches. The range of distances between the centers of the first threaded cleat stud receiving hole 772 in the lateral plantar flange 770 and the second threaded cleat stud receiving hole 784 in the medial plantar flange 780, shown at D, is about 7.70 inches to about 4.35 inches, and more preferably about 7.95 inches to about 4.10 inches. The range of distances between the centers of the second threaded cleat stud receiving hole 774 in the lateral plantar flange 770 and the first threaded cleat stud receiving hole 782 in the medial plantar flange 780, shown at E, is about 3.25 inches to about 7.05 inches, and more preferably about 3.00 inches to about 7.30 inches. The range of distances between the centers of the second threaded cleat stud receiving hole 784 in the medial plantar flange 780 and the second threaded cleat stud receiving hole 774 in the lateral plantar flange 770, shown at F, is about 1.70 inches to about 7.95 inches, and more preferably about 1.95 inches to about 7.70 inches.

Figure 9:
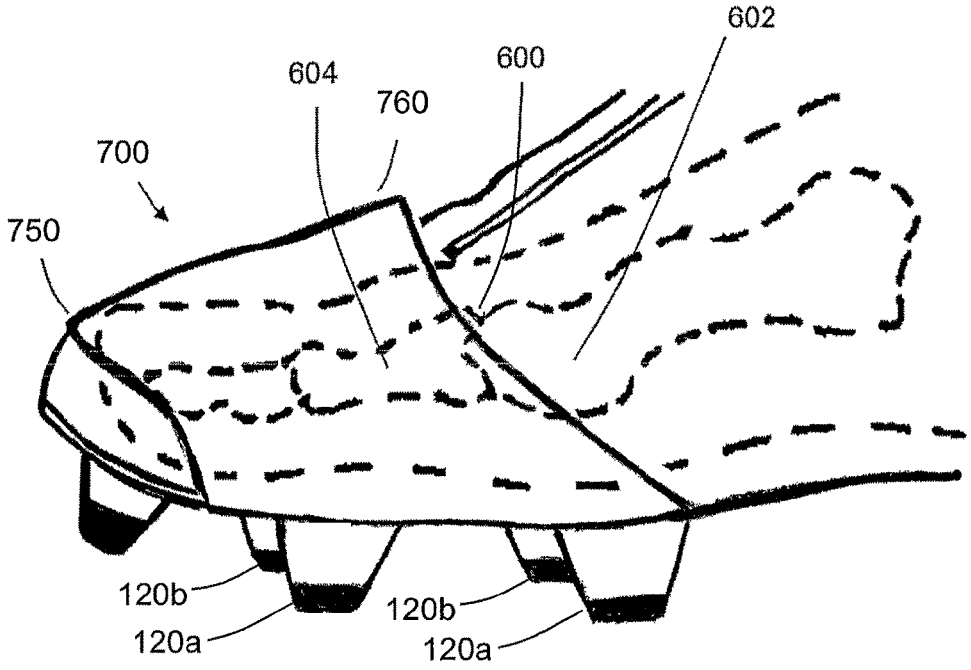
FIG. 9 is a side view of the second embodiment of a toe protector attached to a left foot cleated athletic shoe showing the toe protector in relation to the bone structure of an athlete's left foot.
Figure 10:
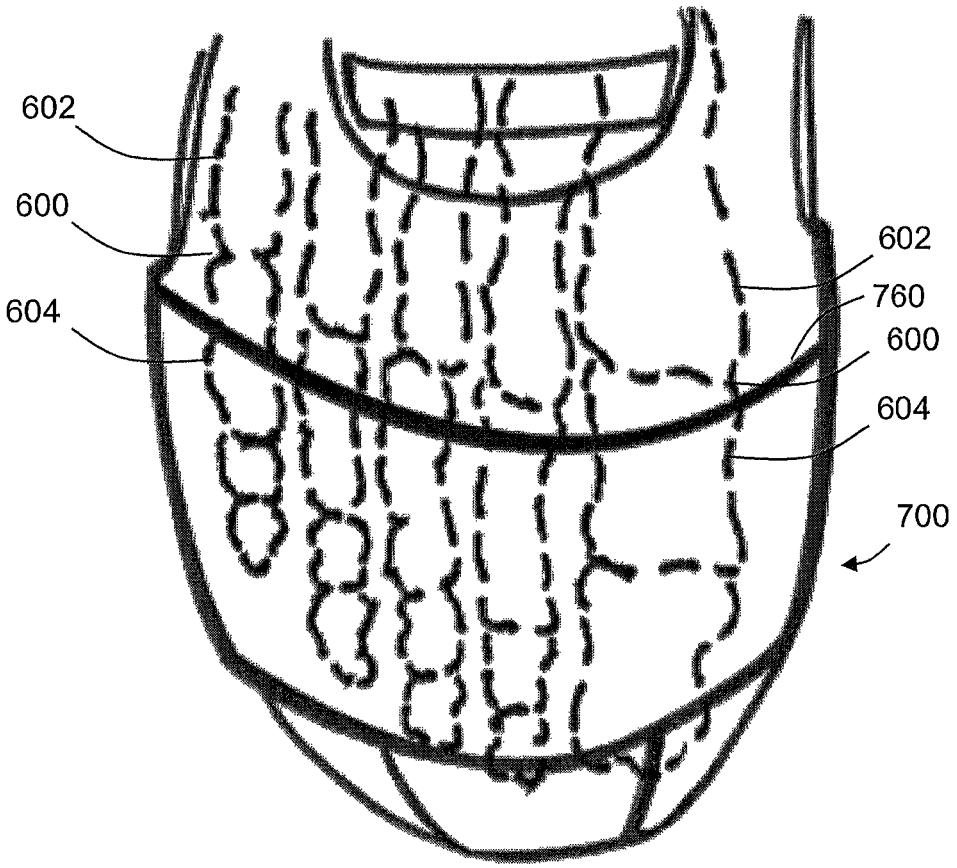
FIG. 10 is a plan view of the second embodiment of a toe protector attached to a right foot cleated athletic shoe showing the toe protector in relation to the bone structure of an athlete's right foot.

As shown in FIGS. 9 and 10, the toe protector 700 is shown attached to the exterior of the cleated footwear 100. This example of the toe protector 700 is secured to the cleated footwear 100 using two removable cleats 120*a* screwed into the lateral side of the forefoot of the sole 150 and two removable cleats 120*b* screwed into the medial side of the forefoot of the sole.

Figure 11:
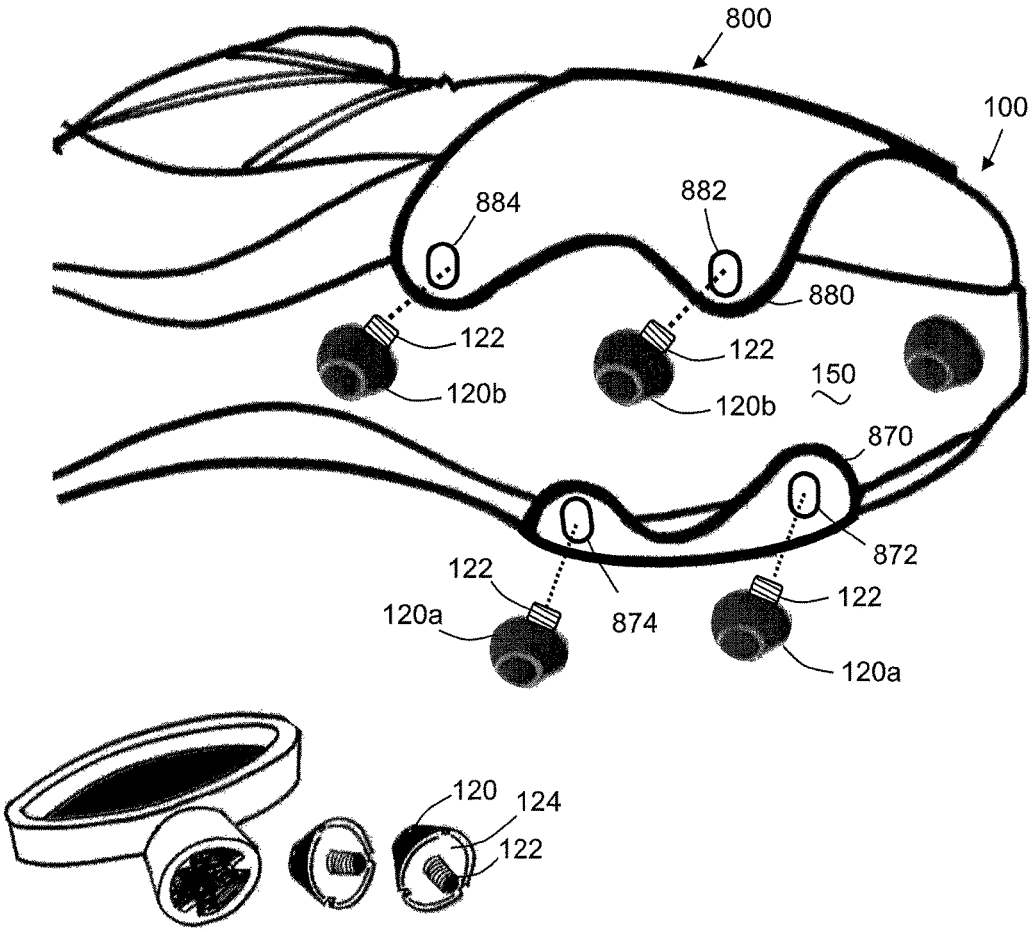
FIG. 11 is a perspective view of another embodiment of the toe protector being attached to the left foot of a cleated athletic shoe with removable cleats.

Referring now to FIG. 11, another example of the toe protector is shown generally at 800. This toe protector 800 has similar features as the toe protector 700 described above, which are shown using similar reference numbers, including a lateral plantar flange 770 and a medial plantar flange 780. The toe protector 800 includes slotted threaded cleat stud receiving holes, including a first slotted hole 872 formed near the proximal end of the lateral plantar flange 770, and a second slotted hole 874 formed near the distal end of the lateral plantar flange. The toe protector 800 also includes a first slotted hole 882 formed near the proximal end of the medial plantar flange 780, and a second slotted hole 884 formed near the distal end of the medial plantar flange. The slotted threaded cleat stud receiving holes enable the toe protector 800 to fit cleated footwear of different sizes as described above.

Figure 12:
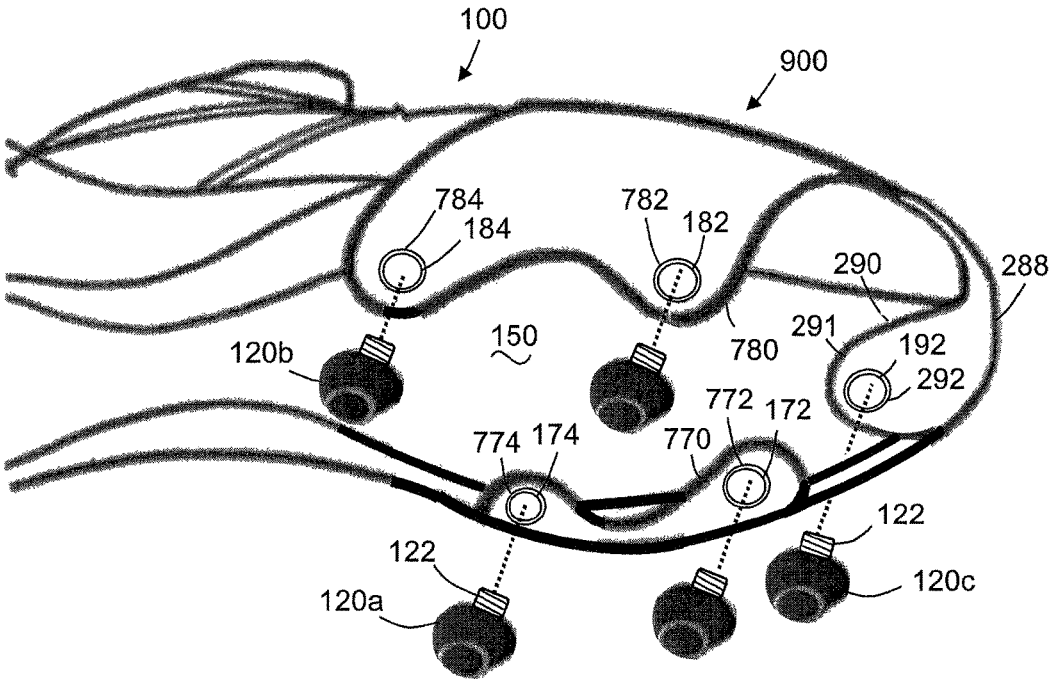
FIG. 12 is a perspective view illustrating another embodiment of the toe protector being attached to a left cleated athletic shoe with removable cleats.

Referring now to FIG. 12, another example of the toe protector is shown generally at 800. This toe protector 800 includes similar features as the toe protector 700 described above, which are shown using similar reference numbers. The toe protector 800 also includes a distal wall 288 extending downwards from the central portion at the distal end, in a similar manner as the toe protector 200 described above. A distal plantar flange 290 extends from the distal wall 288 and terminates in a distal plantar flange end 291. The distal plantar flange 290 includes a threaded cleat stud receiving hole 292 adapted to receive the threaded cleat stud 122 of the front most removable cleat 120*c*. This example of the toe protector 800 is attached to the cleated footwear 100 using two removable cleats 120*a* disposed on the lateral side of the forefoot, two removable cleats 120*b* disposed on the medial side of the forefoot, and the front removable cleat 120*c*.

Figure 13A:
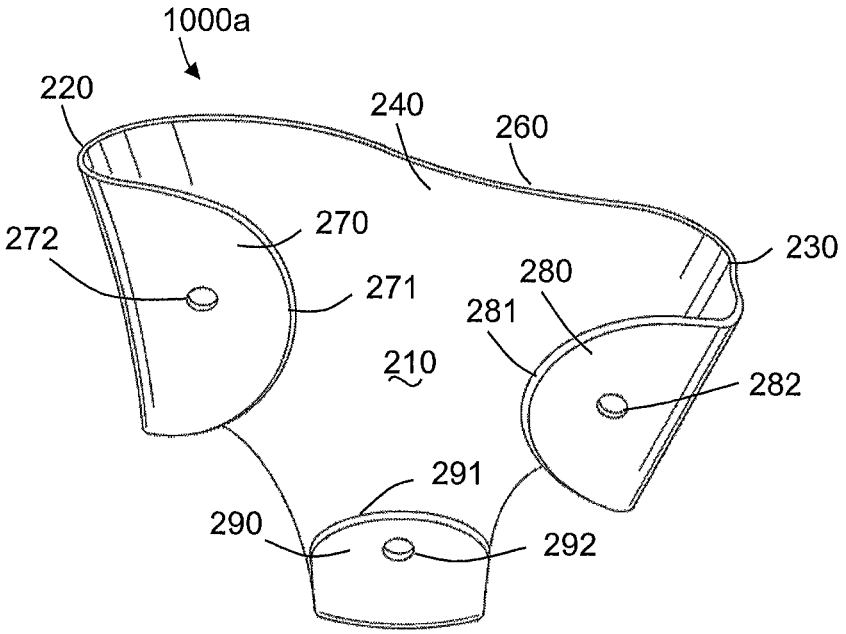
FIG. 13*a* is a perspective bottom view of another embodiment of a left foot toe protector.
Figure 13B:
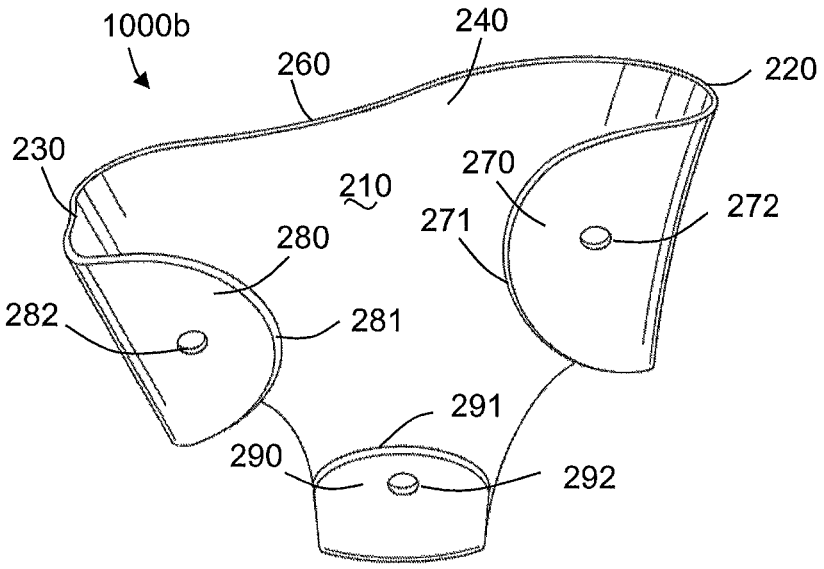
FIG. 13*b* is a perspective bottom view of another embodiment of a right foot toe protector.

Referring now to FIGS. 13*a* and 13*b*, another example of toe protector is shown including a left foot toe protector shown at 1000*a* in FIG. 13*a*, and a right foot toe protector 1000*b* shown in FIG. 3*b*. The toe protectors 1000*a*, 1000*b* include similar features, though medial and lateral features will be disposed on opposite sides, and thus, the toe protectors are referred to generally as the toe protector 1000 and the description of such is applicable to both. The toe protector 1000 includes similar features as the toe protector 200 described above, which are shown using similar reference numbers. The toe protector 1000 includes a single threaded cleat stud receiving hole 272 in the lateral plantar flange 270, a single threaded cleat stud receiving hole 282 in the medial plantar flange 280, and a single threaded cleat stud receiving hole 292 in the distal plantar flange 290. This example of the toe protector 1000 is attached to the cleated footwear 100 using one removable cleat 120*a* disposed on the lateral side of the forefoot, one removable cleat 120 disposed on the medial side of the forefoot, and the front removable cleat 120*c*.

The toe protector 200, 700, 800, 900, 1000 is designed as a "cleat-accessory" to protect and/or treat athletes of all ages using cleated footwear having removable cleats from injury or re-injury. It is designed to be universally applicable to most all athletic footwear having removable cleats available from known manufacturers. It can be easily transferable to other similarly sized cleated footwear. In addition to preventing injuries, it also can be used post-injury to provide preventative protection against re-injury, thereby providing the athlete an earlier return to practice/competition. The toe protector 200, 700, 800, 900, 1000 can be used on grass or turf fields without damaging either the playing surface or the athlete's mobility on the playing surface.

We claim:

1. A toe protector in combination with a cleated athletic footwear, comprising:

the cleated athletic footwear having a toe-box and removable cleats, each removable cleat having a threaded cleat stud extending from a cleat base, and the toe protector comprising a molded semi-rigid arc-shaped body formed of plastic having a three dimensional shape prior to attachment to the cleated athletic footwear, the three dimensional shape defined by a lateral wall of the body, a medial wall of the body, a central portion of the body disposed between the lateral wall and the medial wall, the lateral wall having a lateral plantar flange extending from a lower portion of the lateral wall and terminating in a lateral plantar flange end, the lateral plantar flange having at least one threaded cleat stud receiving hole, and the medial wall having a medial plantar flange extending from a lower portion of the medial wall and terminating in a medial plantar flange end, the medial plantar flange having at least one threaded cleat stud receiving hole;

wherein the plastic has a tensile strength between 4000 psi and 16000 psi, a Rockwell hardness score of between R90 and R126 and an impact strength of 1.5 ft-lbs/in to 18 ft-lbs/in.

wherein the toe protector is adapted to be removably attached over at least a portion of the toe-box of the cleated athletic footwear with at least one of said removable cleats, the threaded cleat stud of said at least one removable cleat extending through the at least one threaded cleat stud receiving hole in at least one of the lateral or medial plantar flanges; and wherein the toe protector further comprises a distal end, a distal wall extending downwards from the distal end and extending over the front of the toe box such that when the toe protector is attached to the cleated athletic footwear, a portion of the of the toe-box of the cleated athletic footwear is exposed adjacent to the distal end of the toe protector, and a distal plantar flange extending from a lower portion of the distal wall, the distal plantar flange terminating in a distal plantar flange end, wherein the distal plantar flange includes at least one threaded cleat stud receiving hole.

2. The toe protector combination of claim 1 wherein the lateral plantar flange end is spaced apart from the medial plantar flange end.

3. The toe protector combination of claim 1 wherein the threaded cleat stud receiving hole in the lateral plantar flange and the medial plantar flange has a size which is smaller than the cleat base.

4. The toe protector combination of claim 1 wherein the at least one threaded cleat stud receiving hole in the distal plantar flange has a size which is smaller than the cleat base.

5. The toe protector combination of claim 1 wherein the distal plantar flange includes two threaded cleat stud receiving holes.

6. The toe protector combination of claim 5 wherein the distal plantar flange includes a first threaded cleat stud receiving hole disposed adjacent the distal plantar flange end and a second threaded cleat stud receiving hole disposed between the first threaded cleat stud receiving hole and the distal wall portion.

7. The toe protector combination of claim 1 wherein the lateral plantar flange includes a pair of threaded cleat stud receiving holes.

8. The toe protector combination of claim 7 wherein the medial plantar flange includes a single threaded cleat stud receiving hole.

9. The toe protector combination of claim 1 wherein one or more of the threaded cleat stud receiving holes are round.

10. The toe protector combination of claim 1 wherein one or more of the threaded cleat stud receiving holes are slotted.

11. The toe protector combination of claim 1 wherein the central portion includes a parabolic shaped proximal end extending between the lateral wall and the medial wall.

12. The toe protector combination of claim 1 wherein the body is formed of at least one of Acrylonitrile Butadiene Styrene, polycarbonate, and polypropylene.

13. The toe protector combination of claim 1, wherein the lateral and medial walls are capable of being pulled apart such as to facilitate attachment of the toe protector to the cleated athletic footwear.

14. The toe protector combination of claim 1, wherein the body is of a unitary, one-piece construction comprised of acrylonitrile Butadiene Styrene (ABS) having a tensile strength between 4000 psi and 7000 psi and a Rockwell hardness score between R90 and R120, a weight between 20 grams and 30 grams, a thickness of 0.0625 inches, and an impact strength between 5.2 ft-lbs/in and 7.7 ft-lbs/in.

15. The toe protector combination of claim 1, wherein the body is of a unitary, one-piece construction comprised of polycarbonate having a tensile strength between 8000 psi and 16000 psi, a Rockwell hardness score between R118 and R126, a weight of 25 grams, a thickness between 0.08 and 0.1 inches, and an impact strength between 1.5 ft-lbs/in and 18 ft-lbs/in.

* * * * *